US005738423A

United States Patent [19]

Alfaro

[11] Patent Number: 5,738,423

[45] Date of Patent: Apr. 14, 1998

[54] CHILD'S TOY TOOL CABINET

[76] Inventor: Kathy Alfaro, 2312 Thaddeous Ct., Escalon, Calif. 95320

[21] Appl. No.: 761,846

[22] Filed: Dec. 9, 1996

[51] Int. Cl.[6] ..... A47B 81/00

[52] U.S. Cl. ..... 312/290; 312/244; 312/330.1; 312/249.11

[58] Field of Search ..... 312/290, 902, 312/327, 328, 324, 326, 329, 249.8, 249.11, 330.1, 244, 332.1

[56] References Cited

U.S. PATENT DOCUMENTS

| | | | |
|---|---|---|---|
| 447,661 | 3/1891 | Burk | 312/290 X |
| 1,543,980 | 6/1925 | Blood | 312/290 |
| 3,251,638 | 5/1966 | Schwartz | 312/244 |
| 3,399,939 | 9/1968 | Anderson | 312/244 X |
| 5,011,241 | 4/1991 | Horton et al. | 312/330.1 |
| 5,294,196 | 3/1994 | Chen | 312/249.11 X |
| 5,411,165 | 5/1995 | Ellis | 312/330.1 X |
| 5,489,106 | 2/1996 | Engelking et al. | 312/290 X |

FOREIGN PATENT DOCUMENTS

| | | | |
|---|---|---|---|
| 1037462 | 9/1953 | France | 312/290 |
| 165751 | of 0000 | Germany | 312/290 |
| 3616347 | 9/1987 | Germany | 312/330.1 |
| 0000011 | 1/1991 | Japan | 312/330.1 |

*Primary Examiner*—Peter M. Cuomo
*Assistant Examiner*—Hanh V. Tran
*Attorney, Agent, or Firm*—Michael I. Kroll

[57] ABSTRACT

A child's toy tool cabinet (10) comprising a housing (12) having a top compartment (14) and a bottom front compartment (16) for holding various play tools (18) and toys (20) therein. A plurality of tote tray drawers (22) are carried in the housing (12) between the top compartment and the bottom front compartment (16) for holding additional play tools (18) therein, so that a child (24) can play with and utilize the play tools (18) and toys. (20) in a safe manner.

2 Claims, 3 Drawing Sheets

CHILD'S TOY TOOL CABINET

BACKGROUND OF THE INVENTION

1. Field of the Invention

The instant invention relates generally to tool tote boxes and more specifically it relates to a child toy tool cabinet.

2. Description of the Prior Art

Numerous tool tote boxes have been provided in prior art that are adapted to store and carry various tools, nails, supplies and other equipment, so as to perform various types of maintenance jobs. While these units may be suitable for the particular purpose to which they address, they would not be as suitable for the purposes of the present invention as heretofore described.

SUMMARY OF THE INVENTION

A primary object of the present invention is to provide a child's toy tool cabinet that will overcome the shortcomings of the prior art devices.

Another object is to provide a child's toy tool cabinet that will simulate an adult tool cabinet, in which a young child can play with in safety in conjunction with play tools.

An additional object is to provide a child's toy tool cabinet that will be appealing to children and will help children with motor skills and will for parents alleviate the danger for their children, since play tools are not hazardous to use by the children.

A further object is to provide a child's toy tool cabinet that is simple and easy to use.

A still further object is to provide a child's toy tool cabinet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
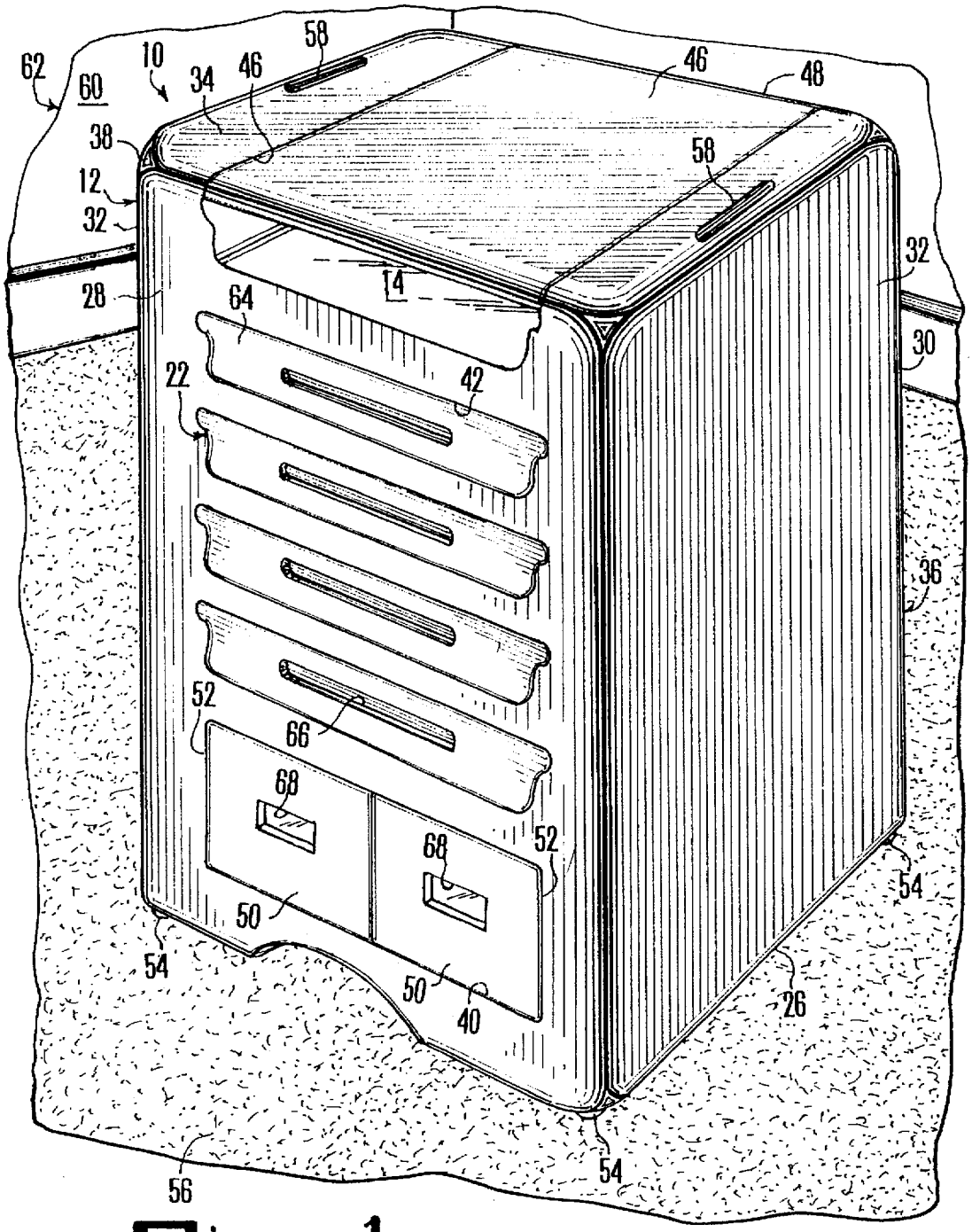
FIG. 1 is a perspective view of the instant invention standing on a floor in a room of a building.
Figure 2:
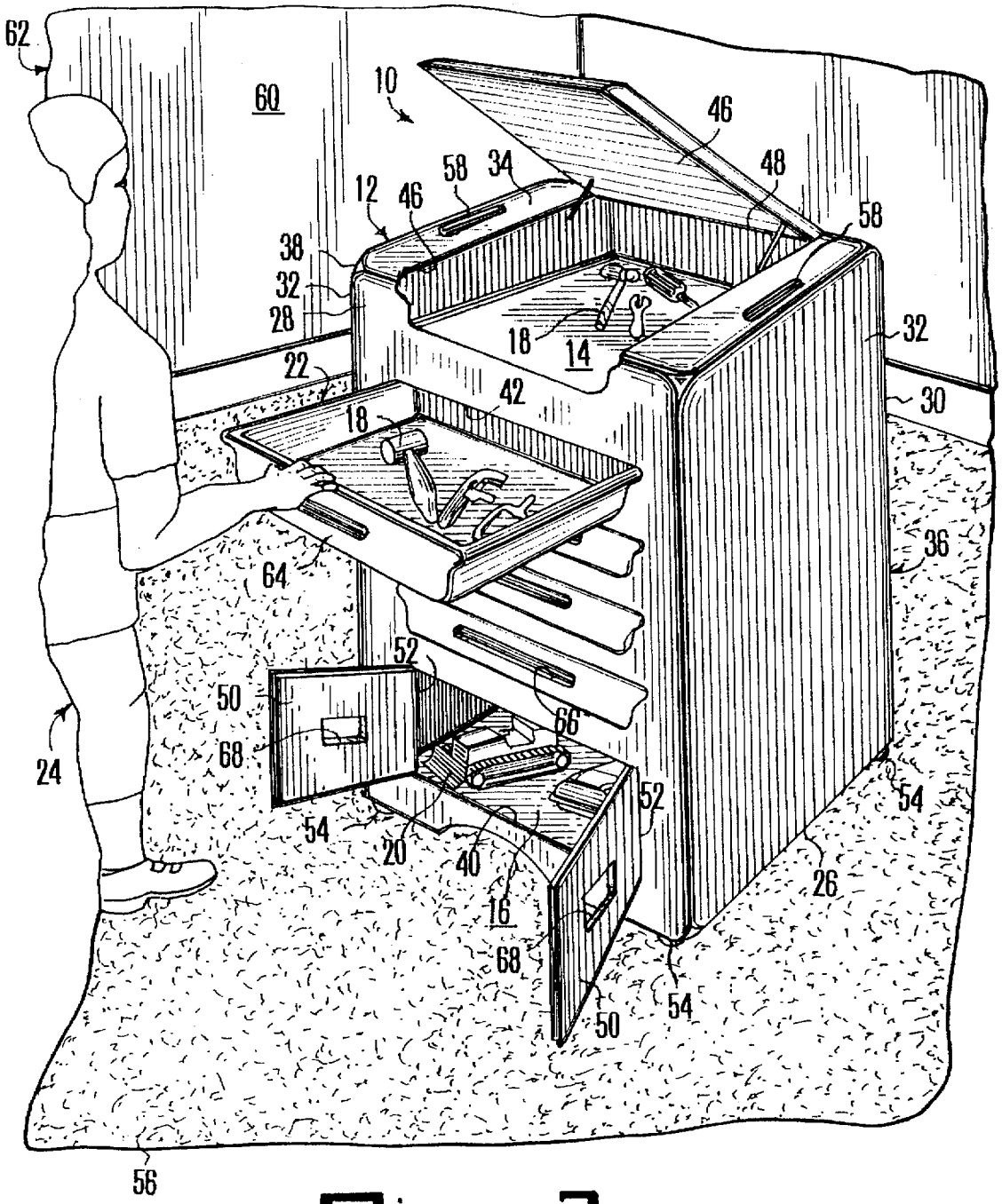
FIG. 2 is a perspective view similar to FIG. 1, with the top lid and the bottom front doors opened and one of the tote tray drawers being pulled out by a child.
Figure 3:
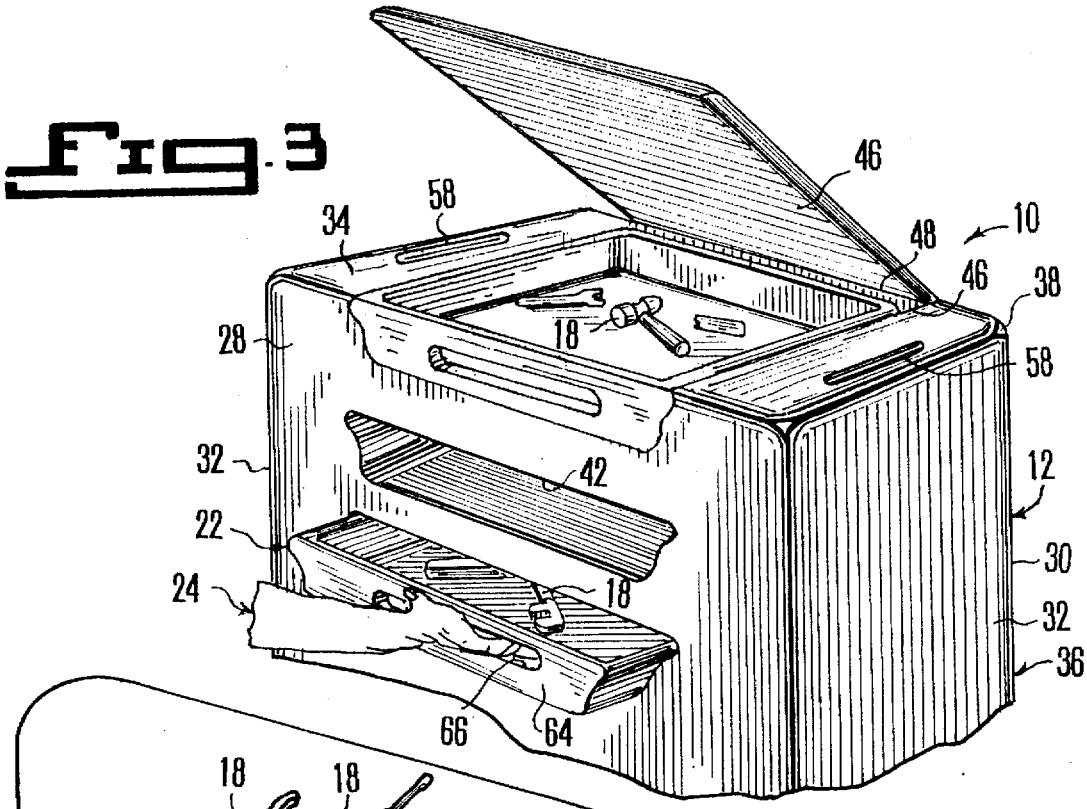
FIG. 3 is a perspective view of a top portion of the instant invention, with one of the tote tray drawers placed into the top compartment.

Turning now descriptively to the drawings, in which similar reference characters denote similar elements throughout the several views, FIGS. 1 through 3 illustrate a child's toy tool cabinet 10 comprising a housing 12 having a top compartment 14 and a bottom front compartment 16, for holding various play tools 18 and toys 20 therein. A plurality of tote tray drawers 22 are carried in the housing 12 between the top compartment 14 and the bottom front compartment 16 for holding additional play tools 18 therein, so that a child 24 can play with and utilize the play tools 18 and toys 20 in a safe manner.

A front wall 28 extends upwardly from the bottom wall 26. A rear wall 30 extends upwardly from the bottom wall 26. A pair of side walls 32 extend upwardly from the bottom wall 26. A top wall 34 is over the bottom wall 26, the front wall 28, the rear wall 30 and the side walls 32, so as to form an upstanding rectangular shaped box configuration 36, with rounded corners 38 for safety.

The front wall 28 has a bottom front aperture 40, for access into the bottom front compartment 16. The housing 12 has a plurality of front open chambers 42, to accommodate all of the tote tray drawers 22 therein.

The top wall 34 has a top opening 46 for access into the top compartment 14 and is shaped to accommodate one of the tote tray drawers 22. A top lid 46 is hinged rearwardly at 48 to the top wall 34 at the top opening 46.

The top lid 46 can be closed over the top compartment 14, even with one of the tote tray drawers 22 placed into the top compartment 14. A pair of bottom front doors 50 are hinged to opposite sides of the bottom front aperture 28 at 52, so that the bottom front doors 50 can be closed against the bottom front compartment 16.

A caster 54 is located at reach bottom corner of the housing 12, to move the housing 12 along a generally flat horizontal surface 56. A pair of recessed handles 58 are provided. Each handle 58 is formed in the top wall 34 adjacent the side wall 32. The child 24 can maneuver the housing 12 along the generally flat horizontal surface 56, which can be a floor of a room 60 in a building 62.

Each tote tray drawer 22 has a front panel 64 with a horizontal slot 66 therein. The front horizontal slot 66 can function as a pull out handle and allow the child 24 to see any play tool 18 and toys 20, placed into the tote tray drawer 22 after being inserted into the housing 12. Each bottom front door 50 has a horizontal opening 68 therein. The horizontal opening 68 can function as a handle and allow the child 24 to see any play tool and toys 20, placed into the bottom front compartment 16.

Figure 4:
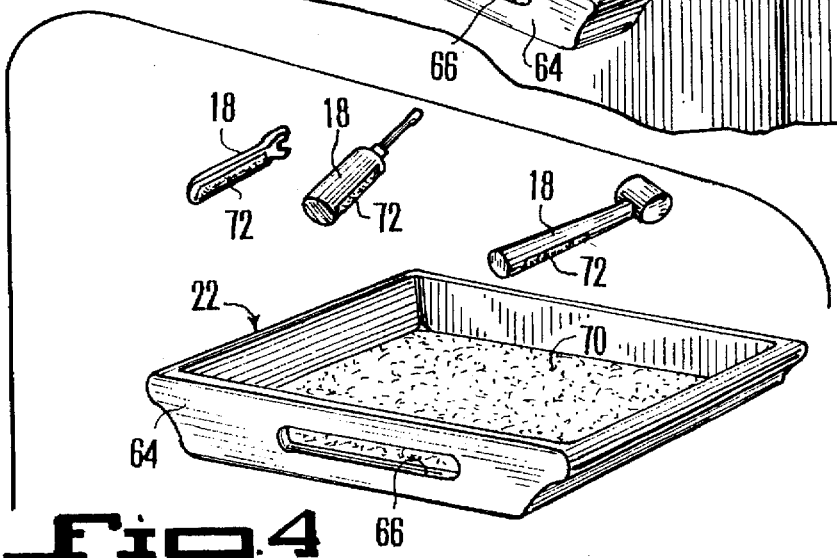
FIG. 4 is a perspective view of one of the tote tray drawers and some of the play tools with VELCRO thereon exploded therefrom.
Figure 5:
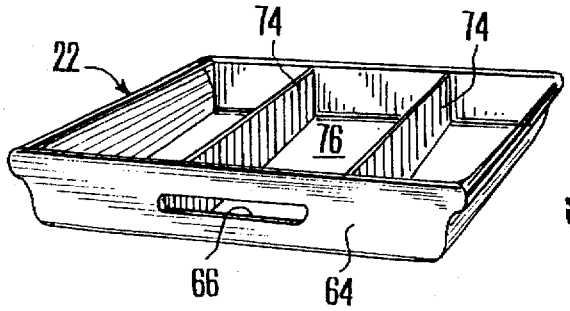
FIG. 5 is a perspective view of one of the tote tray drawers with partitions to separate the play tools therein.

As shown in FIG. 4, a VELCRO pad 7 can be affixed to the bottom of each tote tray drawer 22, while a VELCRO strip 72 can be affixed to each play tool 18. When each play tool 18 is placed into each tote tray drawer 22, the VELCRO strips 72 will mate with the VELCRO pad 70, to hold the play tools 18 in stationary positions therein, to prevent rattling and loss of the play tools 18. Each tote tray drawer 22, as shown in FIG. 5, can have at least one partition 74 therein to form sub-compartments 76, so that the play tools 18 can be placed into the sub-compartments 76 for storage.

LIST OF REFERENCE NUMBERS

10 child's toy tool cabinet
12 housing of 10
14 top compartment in 12

16 bottom front compartment in 12
18 play tool
20 toy
22 tote tray drawer of 10
24 child
26 bottom wall of 12
28 front wall of 12
30 rear wall of 12
32 side wall of 12
34 top wall of 12
36 upstanding rectangular shaped box configuration for 12
38 rounded corner of 36
40 bottom front aperture in 28
42 front open chambers in 12
44 top opening in 34
46 top lid of 10
48 rearward hinge of 46
50 bottom front door of 10
52 side hinge of 50
54 caster of 10
56 generally flat horizontal surface (floor)
58 recessed handle of 10 in 34
60 room in 62
62 building
64 front panel of 22
66 horizontal slot in 64
68 horizontal opening in 50
70 VELCRO pad in 22
72 VELCRO strip on 18
74 partition in 22
76 sub-compartment in 22

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A child's toy tool cabinet in combination with toy tools comprising:

a) a housing having a top compartment and a bottom front compartment for holding various play tools and toys therein, said housing comprising a bottom wall, a front wall extending upwardly from said bottom wall, a rear wall extending upwardly from said bottom wall, a pair of side walls extending upwardly from said bottom wall, and a top wall over said bottom wall, said front wall, said rear wall, and said side walls forming an upstanding rectangular shaped box configuration with rounded corners for safety;

b) a plurality of tote tray drawers carried in said housing between said top compartment and said bottom front compartment for holding additional play tools therein, so that a child can play with and utilize the play tools and toys in a safe manner;

c) said front wall having a bottom front aperture for access into said bottom front compartment and a plurality of front open chambers to accommodate all of said tote tray drawers therein, and said top wall having a top opening for access into said top compartment wherein said top compartment is shaped to accommodate one of said tote tray drawers, said bottom front aperture having a pair of bottom front doors hinged at opposite sides of said bottom front aperture for closing said bottom front compartment;

d) a top lid hinged rearwardly to said top wall at said top opening for closing said top compartment even with one of said tote tray drawers placed into said top compartment;

e) means for permitting convenient movement of said cabinet comprising a caster located at each bottom corner of said housing and a recess in said top wall adjacent each of said side walls for permitting said child to maneuver said housing along a generally flat horizontal surface;

f) each of said tote tray drawer having a front panel and said bottom front drawers containing means for permitting viewing of the contents of the drawer and functioning as a pull out handle comprising a horizontal slot larger enough for such use;

g) a hook or loop fastener pad affixed to the bottom of each said tote tray drawer and a corresponding loop or hook fastener affixed to each said play tool to hold said play tools in stationary positions within the drawer when said tote tray drawer is removed from its compartment.

2. A child's toy tool cabinet as recited in claim 1, further including each said tote tray drawer having at least one partition therein to form sub-compartments, so that the play tools can be placed into the sub-compartments for storage.

* * * * *